United States Patent [19]

Por

[11] 4,099,655

[45] Jul. 11, 1978

[54] POSITION RESPONSIVE TWO-WAY BALL VALVE

[76] Inventor: L. Laslo Por, Christiansted P.O. Box 37, St. Croix, V.I.

[21] Appl. No.: 745,449

[22] Filed: Nov. 26, 1976

[51] Int. Cl.[2] ..... B05B 11/04

[52] U.S. Cl. ..... 222/211

[58] Field of Search ..... 222/211, 212, 481.5, 222/206, 209, 215

[56] References Cited

U.S. PATENT DOCUMENTS

| | | | |
|---|---|---|---|
| 1,735,784 | 11/1929 | Olson | 222/211 |
| 3,985,271 | 10/1976 | Gardner | 222/211 |

FOREIGN PATENT DOCUMENTS

| | | | |
|---|---|---|---|
| 998,021 | 10/1976 | Canada | 222/211 |

*Primary Examiner*—Stanley H. Tollberg
*Attorney, Agent, or Firm*—Jones, Tullar & Cooper

[57] ABSTRACT

This disclosure relates squeezably functioning dispensing and measuring containers, particularly to their valves. A submersible, position and pressure responsive valve is disclosed, specially disposed within a squeezably functioning container the valve, comprising a tubular housing, a ball and two ball seats located on the opposite ends of the tubular housing, whereby the valve or valves keep the container closed in upright and downward position, reduce accidental spilling, and promote cleaning of clogged or contaminated air inlet.

4 Claims, 7 Drawing Figures

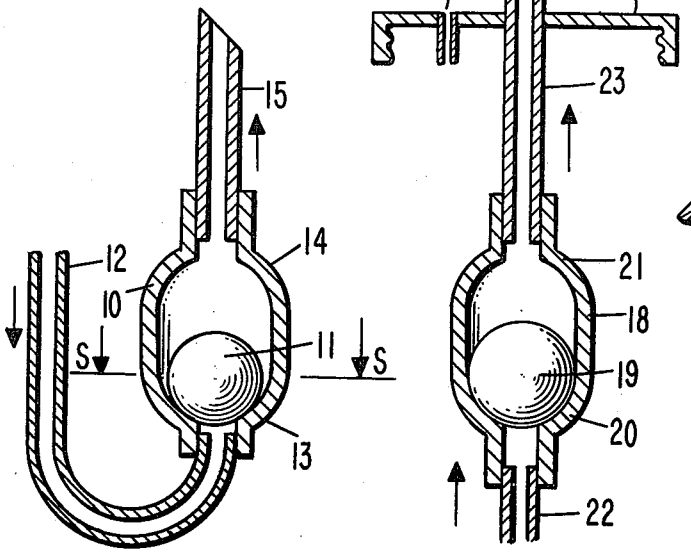
FIG. 1
FIG. 2
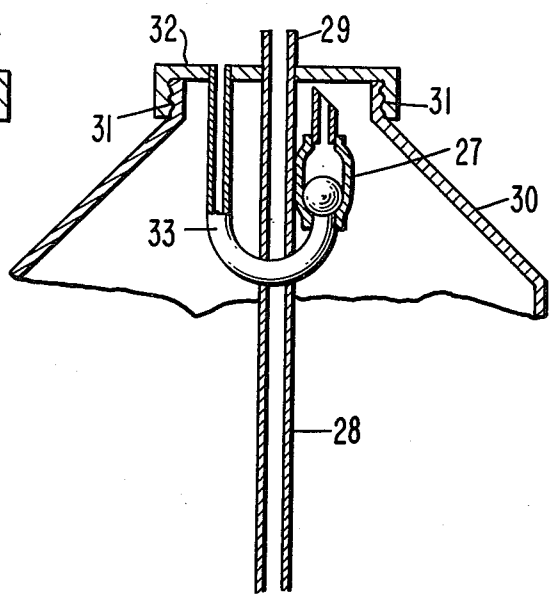
FIG. 3
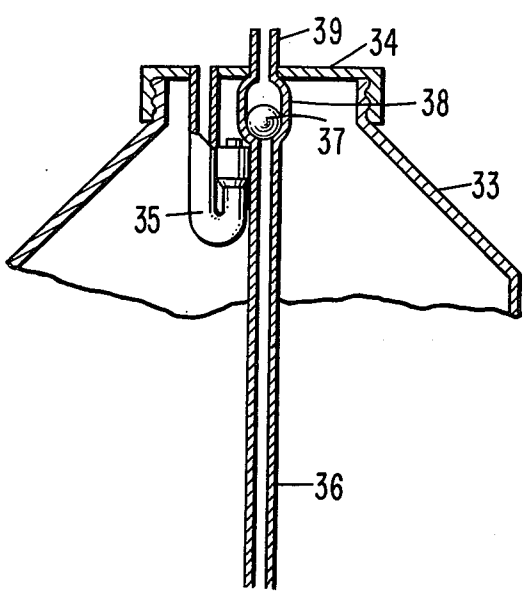
FIG. 4
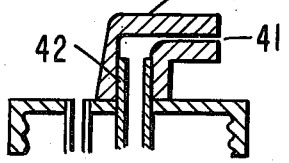
FIG. 5
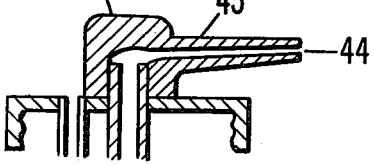
FIG. 6
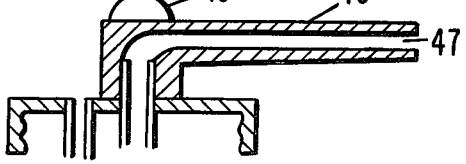
FIG. 7
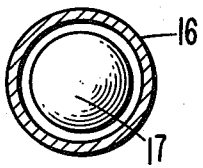
FIG. 1a

POSITION RESPONSIVE TWO-WAY BALL VALVE

BACKGROUND OF THE INVENTION

It is well known, that squeezable containers having a single evacuating aperture, if turned upside down and squeezed, will evacuate an unknown amount of liquid dependent on how hard the container is squeezed. When it is turned upright, the air rushes into the container through the same opening until the dispensed quanity of liquid is replaced by air.

If valves are employed inside a flexible container, it will operate in an upright position to dispense liquids and, as is known, such devices have many advantageous peculiarities.

However, it has been found that during the handling of ball valve equipped, squeezably operating containers the valves have a particular property: accidental, unintentional leaking and spilling. With regard to this property, the object of this practical invention is to provide a new, better functioning type of ball valve for dispensers and to extend its applicability in a greater sector of trade.

Prior art includes U.S. patents to: Por U.S. Pat. No. 3,878,972, Schwartzman U.S. Pat. No. 3,705,668, Ward U.S. Pat. No. 2,761,833, Hall et al. U.S. Pat. No. 2,808,966, Mueller U.S. Pat. No. 3,656,660, and Molineaux et al. U.S. Pat. No. 3,094,250, Schwartzman U.S. Pat. No. 3,794,213.

DESCRIPTION OF THE INVENTION

In a preferred form, the present invention is embodied in a valve which can be used as an air or a fluid valve the valve, comprising a tubularly shaped housing, a freely movable ball and two ball seats located on the opposite ends of housing. The seats cover less than ½ surface of the ball. The housing is large enough to assure a friction free movement of the ball from one seat to the other. In the case of an air valve, the air passageway through the center of the lower ball seat is connected to a U-shaped tube which communicates through the closure member of a flexible container to the atmosphere. Similarly, the air passageway through the upper ball seat is connected to another tube which communicates with the air content of the container. In the case of a fluid valve, the fluid passageway through the center of the lower ball seat is connected to a filler tube which extends downwardly to the bottom of the container/dispenser, while the fluid passageway through the center of the upper ball seat is connected to an evacuation tube which communicates through the closure member with a suitable spout or nozzle for discharge of liquid from within the container. In both an air and a fluid (or liquid) valve, the housings and connected tubes are assembled so as to be liquid and air tight, so they are submersible in the liquid to be discharged without affecting their operation.

The movements of the ball valves in their respective housings are directed automatically by gravitation and also by positive - negative pressures developed inside the sealed container, due to squeezing the flexible side walls of the container.

In a regular standing, or upright, position of a dispenser having both the air and liquid valves of the present invention, both valves are closed by the force of gravity causing the walls to engage the respective lower ball valve seats. Upon squeezing the dispenser to increase the pressure within the container, only the fluid valve opens to allow liquid to flow out the evacuation tube. After squeezing and upon release of the container, a negative pressure develops inside the dispenser so that the relatively higher atmospheric pressure opens the air inlet ball valve and air enters into the dispenser.

If the dispenser is tilted downward, or inverted, both valves will be closed again by the force of gravity causing the respective balls to engage their corresponding upper ball seats. However, in this case, when the container is squeezed, the developed pressure inside the dispenser opens only the U-shaped air inlet tube to permit liquid to be forced out of the external air aperture. In this way a clogged, contaminated air inlet can be cleaned.

A dispenser having a measuring receptacle of the type disclosed in my prior U.S. Pat. No. 3,878,972 functions more accurately with the valve of the present invention because the closed fluid valve hinders any additional liquid, leaking from the container into the measured amount of liquid, during the pouring out period from the receptacle.

Dispensers equipped with the valves of the present invention are reliable and refillable. If liquid flows into air inlet due to any reason, the fluid will be sucked back into the container during the next use.

In certain instances, or for economical reasons, a dispenser can function with one single air valve and an evacuation tube. During compression of the container walls the dispenser will discharge fluid and the air valve will replace the fluid with air. When the compression is ended, regurgitation occurs in the evacuation tube when a fluid valve is not used but the provision of the air valve allows rapid replacement of air in the container so that the squeezing process can be repeated; thus continuous operation is achieved. In this case moderately more compressions have to be applied on the dispenser, compared with a device operated with both a fluid and an air valve.

Despite the fact that the fluid and air valves are closed in both the upright and the inverted, or downward, positions of the dispenser, it is possible that during storage, handling, or delivery it could be exposed to shaking and pressure which could cause discharge of the liquid. To prevent leaking, it is advisable, therefore, that the container during the transfer period be sealed with an ordinary closure cap or that the fluid and air apertures be secured with one or two separate closures.

Summarizing the function of these valves, when the container is squeezed in a normal upright position it will discharge liquids through the fluid outlet and at the same time the air valve will prevent the discharge of air from the container. When the compression is halted and the container pressure released, negative air pressure develops within the container and the relatively higher atmospheric pressure opens the air valve, air then entering into the container. In the inverted position the function of the valves is reversed that is, when the container is squeezed the fluid valve prevents a discharge of liquid through the fluid outlet, but the air valve opens and liquid will be discharged through the air inlet. However, in the inverted position the air inlet tube must first be filled with liquid before there can be a discharge, and thus the dispensing is delayed so that there is no spilling due to minor compression of the dispenser. Unintentional spilling is reduced also because these valves are closed in both the upward and downward position of the dispenser by the effect of gravity on the balls, therefore without compression or shaking the dispenser will not discharge any fluid.

Dispensers equipped with valves of the type disclosed herein are widely applicable, for several kinds of dispensing heads can be fastened by frictional engagement or otherwise to the evacuation tube. With different external apertures of the heads, the dispensers could be useful as a spray, oiling can and with purposefully modified nozzles as enema bottle, for douches, gastric lavage with antidote etc.

BRIEF DESCRIPTION OF DRAWINGS

FIG. 1 is an enlarged cross section of the air valve taken through a central vertical plane and including an attached U shaped tube.

FIG. 1*a* is an enlarged fragmentary section of the air valve of FIG. 1, taken along the line of S—S.

FIG. 2 is an enlarged cross section of a fluid valve taken along a central vertical plane and including a closure cap.

FIG. 3 is a cross section taken through a central vertical plane of the upper part of a dispenser, showing a closure cap, evacuation tube with spout and an air valve.

FIG. 4 is a cross section of the upper part of a dispenser, showing a closure cap with an air inlet and a fluid outlet.

FIG. 5, FIG. 6 and, FIG. 7 are cross sections of dispensing heads with different apertures and with different nozzles.

DESCRIPTION OF A PREFERRED EMBODIMENT

With continued reference to the drawings, there is shown in FIG. 1 a ball valve comprising a housing 10, a ball 11, and a U shaped tube 12 inserted into an air inlet aperture formed in the center of the lower ball seat 13. An air outlet tube 15 is inserted in an air outlet aperture formed in the center of the upper ball seat 14 for communication with the air content of the container in which the valve is mounted. In FIG. 1*a* is shown a cross section of the ball valve and its housing taken on the line S—S of FIG. 1, defining the relation between housing 16 and ball 17.

In FIG. 2 a fluid valve with a closure member is depicted, comprising a housing 18, a ball 19, a lower ball seat 20 and an upper ball seat 21. A filler tube 22 is connected to a liquid inlet aperture formed in the center of the lower ball seat 20, and an evacuating tube 23 is inserted in the liquid outlet aperture formed in the center of the upper ball seat 21, the evacuating tube 23 communicating through closure member 24 with the spout 25. The filler tube 22 extends to the nearest point of the containers bottom. The external air inlet opening 26 shown in FIG. 2 leads to the end of the U shaped tube of the air valve, as shown in FIG. 3.

In FIG. 3 an air valve 27 with an evacuating tube 28 and spout 29 is shown placed in container 30. The container 30 has an upwardly extending neck with threads 31 on the outer surface which are in a threaded sealing engagement with closure member 32. The air valve 27 communicates by way of a U-shaped tube 33 which opens through the closure member 32.

FIG. 4 shows the upper sector of a container 33 with a closure member 34, an air inlet 35 and a fluid outlet, comprising a filler tube 36, a ball 37 in a housing 38 and spout 39.

FIG. 5 represents a spray dispensing head 40 with a small external aperture 41, fastened by frictional engagement to the spout 42.

FIG. 6 shows a dispensing head 43 with a middle sized aperture 44 and with a purposefully modified nozzle 45, representing an oiling can.

FIG. 7 depicts a dispensing head 46 with a large external aperture 47 and with a purposefully modified nozzle 48 for an enema rectal tip.

It will be appreciated that the present invention provides an improved, position responsive two-way ball valve arrangement for use in squeezable dispensing containers. It will be further understood that the foregoing description is illustrative of preferred embodiments, and that the true spirit and scope of the present invention is determined by the following claims.

What is claimed is:

1. A submersible, automatically functioning, pressure and position responsive air valve for a compressible container, comprising:

a closure member for a compressible container;

a first-U-shaped air inlet tube connected through said closure member to atmosphere, said air inlet tube depending from said closure and adapted to extend into the container;

a tubular housing having an upper ball seat at one end and a lower ball seat at the other end, the lower ball seat being connected through said U-shaped air inlet tube to communicate with the atmosphere, and the upper ball seat being connected through a second air inlet tube to communicate with the interior air content of the container; and a ball valve located within said tubular housing and freely movable therein, the position and movement of the ball valve within said housing being directed by gravitation and air pressure so that the ball valve engages said lower ball seat to close said air inlet tube to flow due to compression of the container when the container is in an upright position, and so that the ball engages said upper ball seat upon inversion of the container to open said air inlet tube to flow due to compression of the container.

2. A submersible, automatically functioning, pressure and position responsive fluid valve for the fluid outlet of a compressible container, comprising:

a closure member for a compressible container;

fluid outlet means including an evacuation tube within the container and extending through said closure member for connection to a spout;

a fluid filler tube within the container, said filler tube being adapted to the container;

a tubular housing having an upper ball seat at one end and a lower ball seat at the other end, the upper ball seat being connected to said evacuation tube and the lower ball seat being connected to said filler tube; and a ball valve located within said tubular housing and freely movable therein, the position and movement of the ball valve within said tubular housing being directed by gravitation of the ball and by fluid pressure developed within the container so that the ball valve engages said lower seat when the container is in an upright position and is opened to permit fluid flow therethrough and thence through said evacuation tube upon compression of the container, and upon inversion of the container engages said upper ball seat to close said evacuation tube to fluid flow.

3. The structure of claim 2, further including an air inlet valve for the compressible container, the air inlet valve comprising:

a first, U-shaped air inlet tube connected through said closure member to atmosphere, said air inlet tube depending from said closure member and extending into the container;

a second tubular housing having an upper ball seat at one end and a lower ball seat at the other end, the lower ball seat being connected through said U-shaped inlet tube to communicate with the atmosphere, and the upper ball seat being connected through a second air inlet tube to communicate with the interior air content of the container; and a second ball valve located within said second tubular housing and freely movable therein, the position and movement of said second ball valve within said housing being directed gravitation and air pressure so that in the upright position of said container said second ball valve engages said lower ball valve seat of said second housing to close said inlet air tube to flow during compression of the container, and so that upon inversion of the container said second ball valve engages said upper ball valve seat of said second housing to open said air inlet tube to flow due to compression of the container.

4. A submersible, automatically functioning, pressure and position responsive valve assembly for dispensing fluids, comprising:

a compressible container having a flexible body and an upwardly extending neck portion;

a closure member in sealing engagement with said neck portion;

air inlet means extending into said container, said air inlet means comprising a first tubular housing having upper and lower ball seats on the upper and lower ends thereof, respectively, a first ball valve freely movable within said first tubular housing between its upper and lower ball seats, U-shaped tube means connected between said lower ball seat and said closure member and communicating with atmosphere, and said upper ball seat communicating with the air content of said container, the position and movement of said first ball valve within said first housing being automatically directed by gravitation of the ball and by air pressure;

fluid outlet means within said housing, said fluid outlet means comprising a second tubular housing having upper and lower ball seats on the upper and lower ends thereof, respectively, a second ball valve freely movable within said second tubular housing between its upper and lower ball seats, a fluid filler tube connected to said lower ball seat and extending downwardly into said container, an evacuation tube connected between said upper ball seat and said closure member and adapted for connection through said closure member to a spout for dispensing fluids, the position and movement of said second ball valve within said second housing being automatically directed by gravitation of the ball and by fluid pressure developed inside said container, whereby said container without applied compression is closed by ball valves in both its upright and inverted positions, in the upright position squeezing said flexible container body serving to dispense liquids through said fluid outlet means and releasing said flexible container body serving to draw air into said container through said air inlet means, and in the inverted position squeezing said flexible container body serving to transmit fluid out through said air inlet means.

* * * * *